US008807346B2

(12) United States Patent
Zhang et al.

(10) Patent No.: US 8,807,346 B2
(45) Date of Patent: Aug. 19, 2014

(54) CENTRIFUGAL JIG

(75) Inventors: Chuanzhong Zhang, Qinzhou (CN); Hongliang Liu, Qinzhou (CN); Jingwu Wang, Qinzhou (CN)

(73) Assignee: Qinzhou AuraSource Technology Inc., Qinzhou (CN)

( * ) Notice: Subject to any disclaimer, the term of this patent is extended or adjusted under 35 U.S.C. 154(b) by 0 days.

(21) Appl. No.: 13/635,674

(22) PCT Filed: Mar. 14, 2011

(86) PCT No.: PCT/CN2011/071763

§ 371 (c)(1),
(2), (4) Date: Nov. 27, 2012

(87) PCT Pub. No.: WO2011/113337

PCT Pub. Date: Sep. 22, 2011

(65) Prior Publication Data

US 2013/0062259 A1 Mar. 14, 2013

(30) Foreign Application Priority Data

Mar. 15, 2010 (CN) ..... 2010 1 0123867

(51) Int. Cl.

| | |
|---|---|
| ***B03B 5/24*** | (2006.01) |
| ***B03B 11/00*** | (2006.01) |
| ***B03B 5/00*** | (2006.01) |

(52) U.S. Cl.

USPC ..... 209/503; 209/490; 209/494; 209/425; 209/426

(58) Field of Classification Search

USPC ..... 209/17, 425, 426, 490, 494, 503, 504

See application file for complete search history.

(56) References Cited

U.S. PATENT DOCUMENTS

| | | | | |
|---|---|---|---|---|
| 4,898,666 | A * | 2/1990 | Kelsey | 209/425 |
| 5,114,569 | A * | 5/1992 | Kelsey | 209/425 |
| 6,613,191 | B2 * | 9/2003 | Rienecker et al. | 162/55 |
| 7,163,106 | B2 * | 1/2007 | Dal Maso | 210/415 |
| 7,384,503 | B2 * | 6/2008 | Hoffmann et al. | 162/49 |
| 2001/0054575 | A1 * | 12/2001 | Kelsey et al. | 209/44 |

FOREIGN PATENT DOCUMENTS

| | | | |
|---|---|---|---|
| CN | 1038948 | A | 1/1990 |
| CN | 2445814 | Y | 9/2001 |
| CN | 2586535 | Y | 11/2003 |
| CN | 2889496 | A | 4/2007 |
| CN | 2892275 | Y | 4/2007 |

OTHER PUBLICATIONS

International Search Report mailed on Jun. 9, 2011 for PCT Patent Application No. PCT/CN2011/071763, filed on Mar. 14, 2011, 5 pages.

* cited by examiner

*Primary Examiner* — Patrick Cicchino

(74) *Attorney, Agent, or Firm* — Kilpatrick Townsend & Stockton LLP

(57) ABSTRACT

This invention relates to a centrifugal jig comprising a rotating device, at least one jig unit and a product receiver. The jig unit includes a hutch chamber, a screen residue chamber, a screen, a feeding device, a discharging device and a pulsator. The jig unit is installed on the rotor at an inclined angle along the movement of the feed. It is used to separate particles of different density in the slurry. The product receiver is fixed on the ground to collect the separated materials discharged from the rotating jig unit. Separated materials are discharged from an outlet of the screen residue chamber in the jig unit. This invention can unselectively separate any size particles of different density in the fine slurry.

20 Claims, 7 Drawing Sheets

CENTRIFUGAL JIG

This application is a U.S. National Phase under 35 USC 371 of PCT Application No. PCT/CN2011/071763 filed Mar. 14, 2011, which claims priority to the Chinese Patent Application No. 201010123867.8 filed Mar. 15, 2010, the disclosures of which are incorporated by reference herein.

TECHNICAL FIELD

The present invention relates to a jig for coal preparation, and particularly to a centrifugal jig.

BACKGROUND ART

Hydraulic cyclones, jigs and heavy media cyclones are widely used apparatus for fine coal preparation. The average particle size of fine coal slurry having practical application can reach 0.01 mm, probably even 0.001 mm. Coal organic components and adhered inorganic mineral particles such as ferrous sulfide and silicon dioxide can be separated effectively by making ultra-fine coal particles. This enables coal further preparation. The separation mechanism of hydraulic cyclone is affected by particle size. That is to say, the effect of separation according to particle density will be affected by particle size. The particle minimum size for jigging and heavy media cycloning is 0.2 mm which makes it difficult to remove inorganic minerals. The settling velocity of particles in the slurry becomes very low under normal gravity when particles become fine. Particles settling may even stop due to interaction force between particles and disturbance caused by ultra-fine particles in the slurry. Therefore, conventional coal preparation equipment based on gravity effect doesn't work. A centrifugal jig has been disclosed in patent PCT/AU86/00016 published on Jul. 31, 1986. It was further improved in patent PCT/AU89/00279 published on Jan. 11, 1990 and patent PCT/AU98/00657 published on Feb. 25, 1999. The centrifugal jig presented in the patent series can separate fine particles with different density by using centrifugal acceleration of tens of gravity. This type of equipment is used to collect small particles of large density by discharging small particles through the screen. However, the preparation of fine coal slurry aims at removing mineral particles of high density and remaining particles of low density.

SUMMARY OF THE INVENTION

This invention discloses a centrifugal jig for separation of components of different density in fine slurry. This centrifugal jig can unselectively separate any size particles of different density in the fine slurry.

In order to achieve the above objects, this centrifugal jig comprises a rotating device, at least one jig unit and a product receiver. The rotating device includes a rotor and a base. The rotor is power-driven to rotate around a vertical shaft. The jig unit includes a hutch chamber, a screen residue chamber, a screen, a feeding device, a discharging device and a pulsator. Similar to structures and functions of the conventional jigs, the jig unit is used to separate particles of different density in the slurry. The jig unit is installed on the rotor at an inclined angle along the movement of the feed. The hutch chamber is located far away from the vertical shaft. The product receiver is fixed on the ground to collect the separated materials discharged from the rotating jig unit. What is special in the centrifugal jig of the present invention is that most of the separated high density materials and low density materials are discharged from an outlet of the screen residue chamber.

The reason of mentioning "most of" is because small amount of material particles inevitability go through the screen into the hutch chamber during the jigging process. This portion of material is called bed material and will be discharged eventually. The high density material and low density material are also called heavy material and lightweight material in industry.

In one example, the inclined angle is equal to the angle between the vector sum of the gravitational force and centripetal force acting on the jig unit and vertical direction. In addition, the screen has a curved surface formed by revolving a parabola which extends along the movement of the feed around the axis of the vertical shaft.

Multiple jig units may be installed on the rotor and they are central symmetric or axial symmetric with respect to the rotating shaft. Air-pulsed jig can be employed and is installed underbed.

In another example, the screen residue chamber is modified to be closed. The separated slurry flows back to the center of the rotating shaft or nearby. Then it departs from rotating condition at or adjacent to the rotating shaft and enters into the separation product receiver.

The jig unit may be changed to three-product structure. The screen of the jig can be modified to a fiber screen. Upwardly stretched fibers are arranged on the upper bar of the screen having a large mesh size to cover screen openings.

In addition, a hutch bed slurry separation unit may be added in the jig unit. This hutch bed slurry separation unit is disposed at the bottom of the hutch chamber. It includes a heavy slurry outlet and a conical shape lightweight slurry outlet adjacent to the bottom of the hutch chamber.

The screen of the jig unit may also contain the lower dilute zone close to the feed inlet and the higher concentrate zone close to the discharge outlet.

PREFERABLE MODE OF CARRYING OUT THE INVENTION

This invention is further explained with reference to detailed examples as follows. Fine coal slurry is used in those examples.

Example 1

Figure 1:
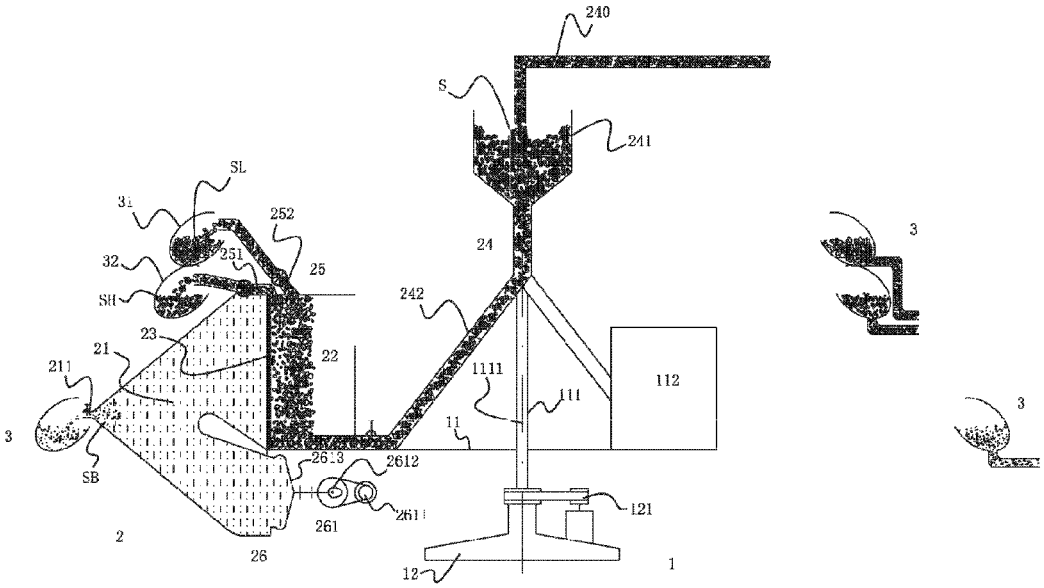
FIG. 1 is a cross sectional view illustrating the main structure of the centrifugal jig.
Figure 2:
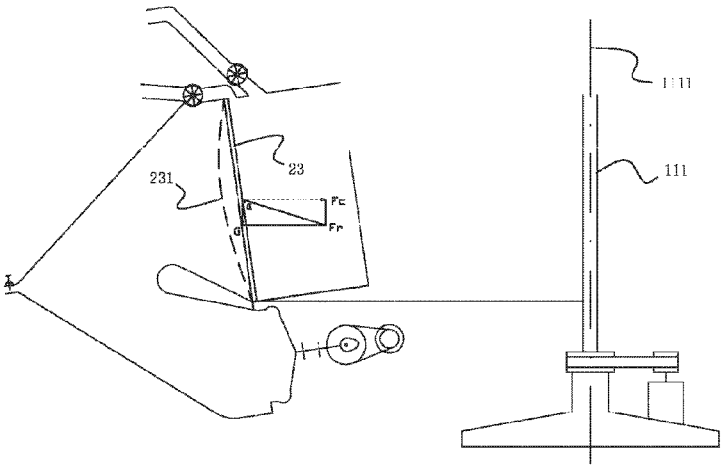
FIG. 2 is a schematic of the inclined angle of the jig unit and the parabolic shape screen.

As shown in FIG. 1 and FIG. 2, this apparatus comprises a rotating device 1, at least one jig unit 2 and a product receiver 3. The rotating device 1 includes a rotor 11 and base 12. The rotor 11 driven by a power drive unit 121 rotates steadily around the axis 1111 of a vertical shaft 111. The jig unit 2 includes a hutch chamber 21, a screen residue chamber 22, a screen 23, a feeding device 24, a discharging device 25 and a pulsator 26. With similar structure and function as the conventional jig, the jig unit is used to separate particles of different density in the slurry. The jig unit 2 is installed on the rotating device 1 at an inclined angle $\alpha$ along the movement of the feed. The hutch chamber 21 is located far away from the vertical shaft 111. The inclined angle $\alpha$ is equal to the angle between the vector sum Fr of the gravitational force G and centripetal force Fc acting on the jig unit 2 and vertical direction. Since the centripetal acceleration can reach tens of gravity, this angle is close to 90 degrees. The jig unit 2 operates under the resultant force field generated by the gravitational force and centrifugal force due to rotation. The product receiver 3 is an annular tank fixed on the ground to collect the separated materials discharged from the rotating jig unit 2. The discharge device 25 of the jig unit 2 discharges materials through outlets instead of through the screen. The outlets include a heavy material outlet 251 and a lightweight material outlet 252. The screen residue chamber 22 which is open in this example is also called launder. During the jigging process, small amount of particles S go through the screen 23 into the hutch chamber 21. Then they are discharged at the bed material outlet 221 on the bottom of the hutch chamber and goes into the product receiver 3. The screen 23 can be a screen with mesh size of 0.2 mm and feldspar ragging bed. The suction force is controlled during machine operation.

Feed slurry S is accepted on the top of the vertical shaft 111 through a feed inlet 240 into a conical shape tub 241 which rotates with the jig unit simultaneously. The slurry then goes through a feed pipe 242 into the hutch chamber under the screen 23. Due to the centrifugal force and push by successive feed, the feed slurry S stratifies and moves upwardly. The lightweight slurry SL and heavy slurry SH discharge at the lightweight slurry exit 251 and heavy slurry exit 252, respectively. Then they enter the corresponding lightweight slurry receiver 31 and heavy slurry receiver 32. The pulsator 26 uses a conventional diaphragm pulsation device 261. As the diaphragm 2613 moves due to the action of the cam drive shaft 2612 powered by the pulsation motor 2611, pulsation is generated in the hutch water. To keep steady rotation of the rotating device 1, a heavy balance object 112 is put on the opposite of the jig unit.

Ideally, the screen 23 has a curved surface formed by revolving a parabola 231 which extends along the movement of the feed around the axis 1111 of the vertical shaft 111. In this way, the screen 23 and the jigging fluid can share the same surface. Based on this, the inclined angle of the screen 23 can be adjusted according to the refuse discharge method. If the screen 23 is narrow and centrifugal force is very large, flat screen plate can be used.

Power supply of the rotating jig unit 2 can be maintained by connecting the slip ring of the vertical shaft with power source of the fixed base. High power slip ring has successful application in spiral CT. The monitor signal of the jig unit can be acquired by wireless communication or serial infrared communication.

The centrifugal jig in example 1 is the simplest version of this invention. Further improvements can be found in the following examples.

Example 2

Figure 3:
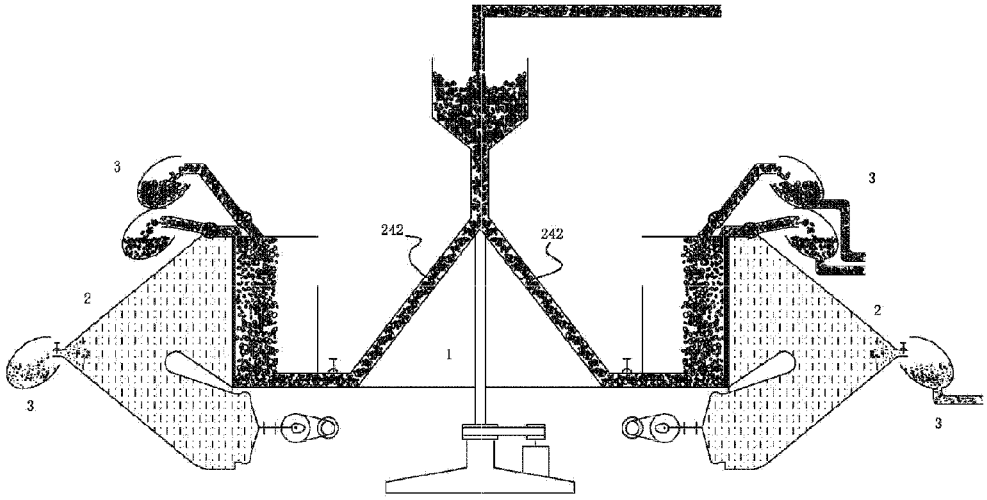
FIG. 3 is a schematic of the centrifugal jig with multiple jig units.

As shown in FIG. 3, on the basis of example 1, multiple jig units are installed on the rotor 11 and they are central symmetric or axial symmetric along the rotating shaft 111. Feed slurry in the tub goes through the feed pipe 242 into each jig unit. The feed slurry goes through each discharge pipe into the corresponding receiver 31 and 32 after separation.

Example 3

On the basis of example 2, due to the existence of multiple jig units, it's more superior to employ air-pulsed jig. All jig units can share one compressed air supply unit and pulse control unit.

Side air-pulsed jig can be used. The rotation radius of the center of mass of the jig unit doesn't change despite the pulsation of the fluid. Therefore, simultaneous operation of the jig units will not cause any disturbance on rotating velocity.

Example 4

Figure 4:
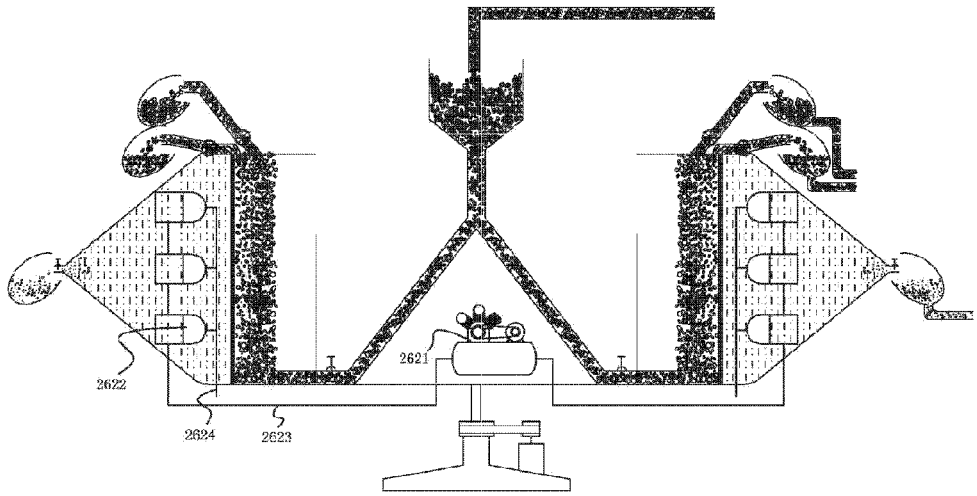
FIG. 4 is a schematic of the centrifugal jig with underbed air-pulsed unit.

As shown in FIG. 4, underbed air-pulsed unit is used in this example.

The underbed air-pulsed unit includes an air compressor and air reservoir 2621, hutch chamber 2622, air inlet pipe 2623, air outlet pipe 2624, and pipe control system. The pipe control system is not included in the figure. Disturbance of rotation can happen due to the rotation radius change of the center of mass of the jig unit caused by pulsation of the fluid. To minimize the disturbance of rotation, the jig units are divided into groups so that the change of the center of mass of each group can be counterbalanced. The underbed air-pulsed jig unit has more compact structure than the side air-pulsed jig unit.

Example 5

Figure 5:
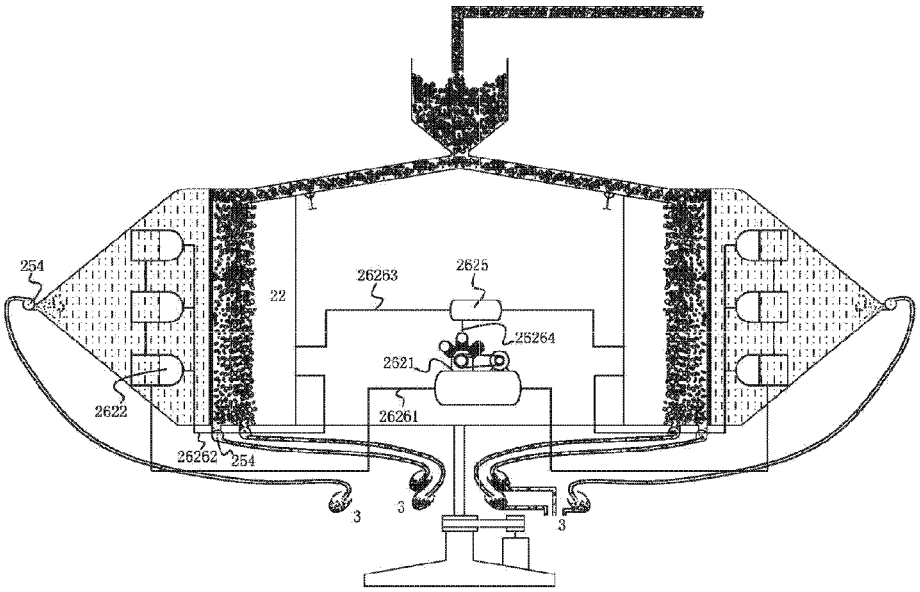
FIG. 5 is a schematic of the centrifugal jig with closed screen residue chamber.
Figure 10:
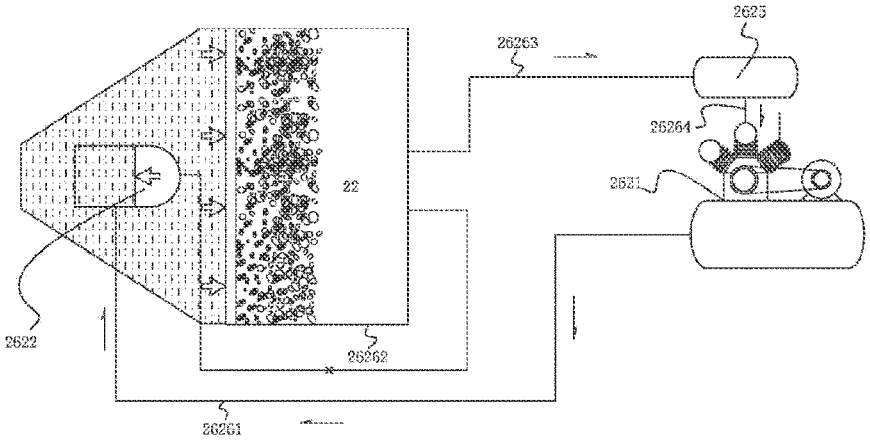
FIG. 10 is a schematic of the air-pulsed unit of the centrifugal jig with closed screen residue chamber, in which water being in an ascending period.
Figure 11:
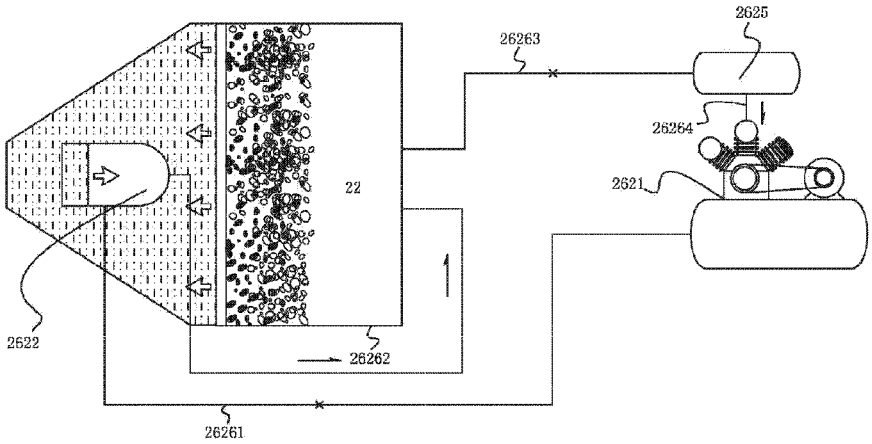
FIG. 11 is a schematic of the air-pulsed unit of the centrifugal jig with closed screen residue chamber, in which water being in a descending period.

As shown in FIG. 5, FIG. 10 and FIG. 11, on the basis of example 4, the screen residue chamber is modified to be closed.

There will be some splash when the separated slurry goes through the outlet pipe into the receiver. In addition, there will be kinetic energy loss when the slurry discharges at a high velocity from the jig unit. As a result, this increases energy consumption of the equipment. Alternatively, the separated slurry flows back to the center of the vertical shaft or nearby. Then it departs from rotating condition and goes into the receiver fixed on the ground. In this way, the kinetic energy of the slurry can be recycled. However, centrifugal force needs to be overcome as the slurry flows from the outward back to the rotating shaft. By using closed screen residue chamber, high pressure can be kept as the system works. Meanwhile, the diameter and installation angle of the outlet pipe are controlled so as to force the slurry to flow back to the vertical shaft and avoid centrifugal settling of slurry particles. The slurry can flow into the receiver 141 freely due to the pressure generated by the altitude difference between the receiver and outlet pipe. To control the flow of the slurry in a better way and maintain appropriate ragging bed depth, a slurry pump 254 can be used at the outlet.

In this example, air pulse can be controlled by controlling the air flow in the screen residual chamber. The air-pulsed unit comprises an air compressor and air reservoir 2621, hutch chamber 2622, screen residual chamber 22, air recycling container 2625, and piping line 26261, 26262, 26263, 26264 for the above 4 components. During the upward pulsion period as shown in FIG. 10, piping line 26261 opens and air flows from the air compressor and air reservoir 2621 into the hutch chamber 2622. Meanwhile, piping line 26263 opens and air in the screen residual chamber flows into the air recycling container 2623. Piping line 26262 closes and hutch water moves upwardly. During the downward pulsion period as shown in FIG. 11, piping line 26261 closes and piping line 26262 opens. Piping line 26263 closes and hutch water moves downwardly. The piping line 26264 between the air recycling container 2623 and air compressor and air reservoir 2621 keeps open during the operation. The function of the air recycling container 2623 is to recycle the compressed air from the screen residual chamber so that energy consumption can be reduced. The system can still work if the air recycling container 2623 is removed.

The jig unit with closed screen residual chamber structure can also be used in jigs employing other types of pulsator, such as diaphragm pulsion device.

Example 6

Figure 6:
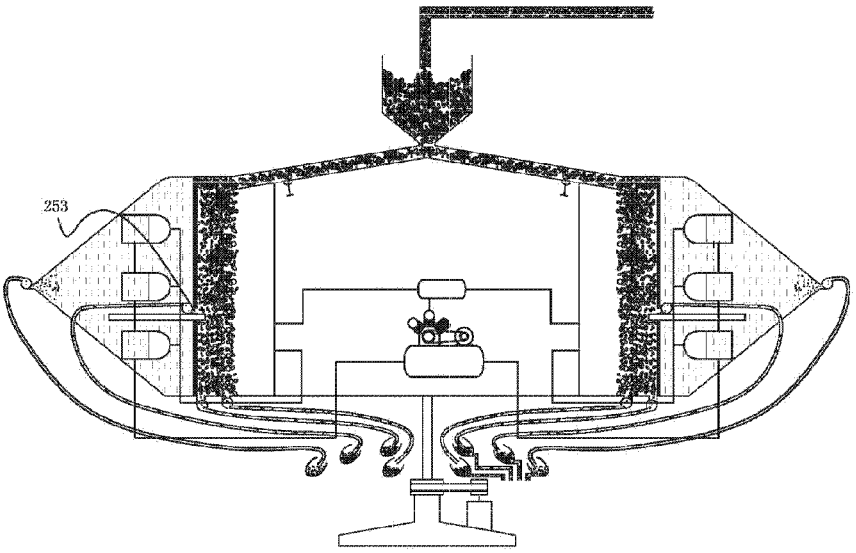
FIG. 6 is a schematic of the centrifugal jig with three-product jig unit.

As shown in FIG. 6, on the basis of example 5, two-product structure for each jig unit is changed to three-product structure.

To further reduce the heavy particle content in the lightweight product, the jig unit is altered to have three-product structure. It is similar to the conventional three-product jig. A middlings outlet 253 and corresponding receiver are added in the jig unit.

Example 7

Figure 7:
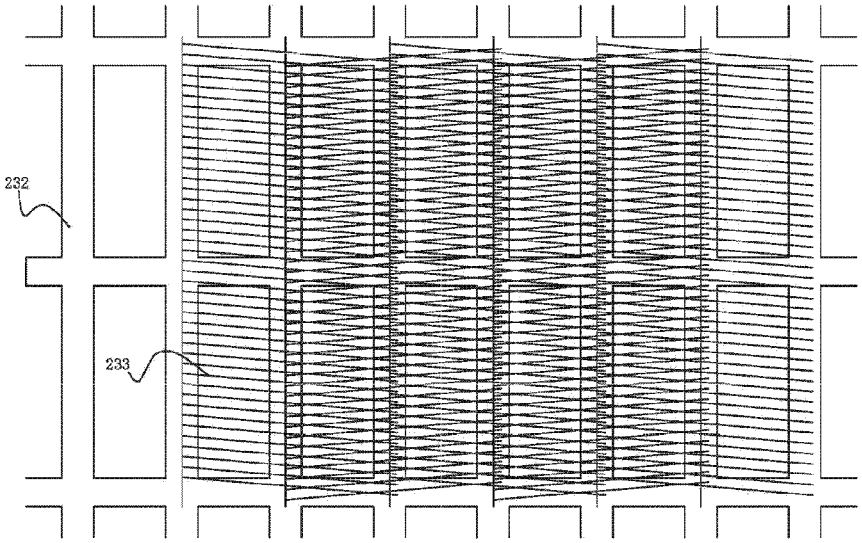
FIG. 7 is a top view of the fiber screen.
Figure 8:
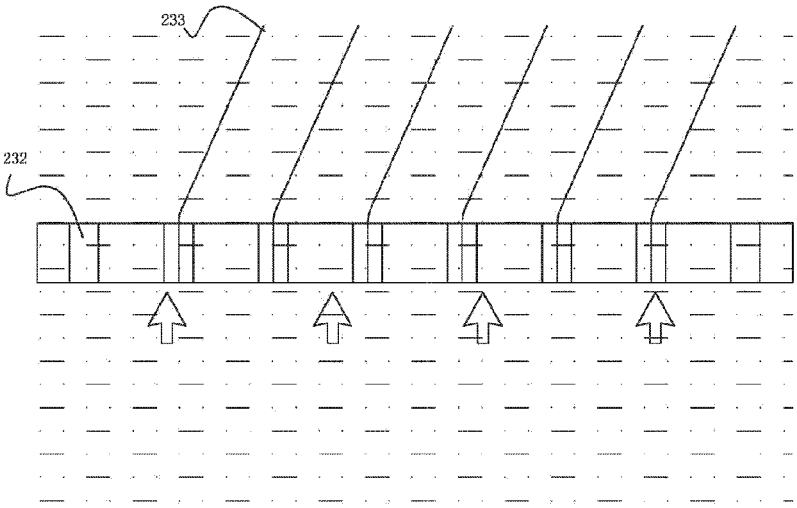
FIG. 8 is a front view of the fiber screen, in which ascending state of water is shown.
Figure 9:
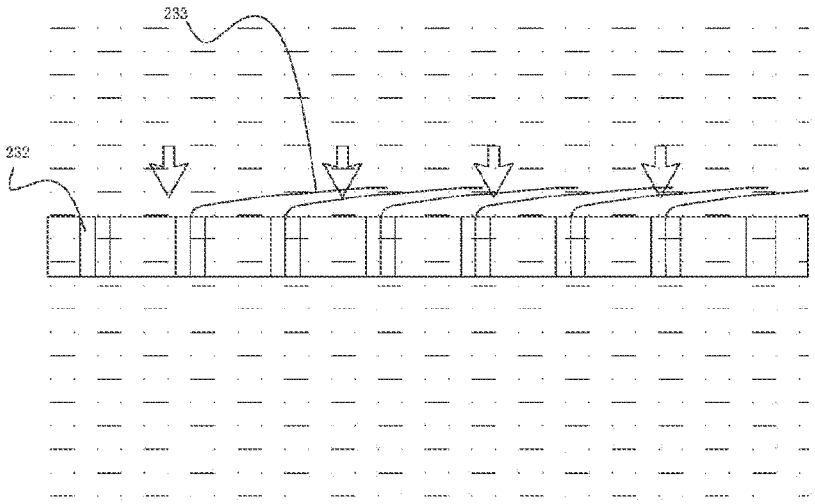
FIG. 9 is a front view of the fiber screen, in which descending state of water is shown.

As shown in FIG. 7-FIG. 9, on the basis of example 6, the screen is modified to a fiber screen.

The mesh size of screens in current jigs is normally larger than 0.2 mm. The screen with 0.2 mm mesh size and feldspar ragging bed is used in example 1. This screen induces large flow resistance which may affect the jigging and let many useful particles go through the screen.

A screen with fibers can be used to overcome this problem. Upwardly stretched fibers 233 are arranged on the upper bar 232 of the screen of large mesh size to cover screen openings. Fibers 233 are arranged parallel in a single line. It is better for fibers to incline to the flow direction. Fibers will not increase resistance for upwardly moving water and will effectively stop slurry particles going through the screen into the hutch chamber. The thickness, length, density and inclined angle of fibers can be adjusted according to the size of slurry particles. Generally speaking, thick, hard and short fibers are used for large particles while thin, soft and long fibers are used for small particles. Combination of those two types of fibers can be used for particles of large size variation. Fibers of adjacent rows can be arranged to incline to two slightly different directions. This could reduce the resistance on downwardly moving water. This screen structure can also be used in conventional jigs.

Example 8

Figure 12:
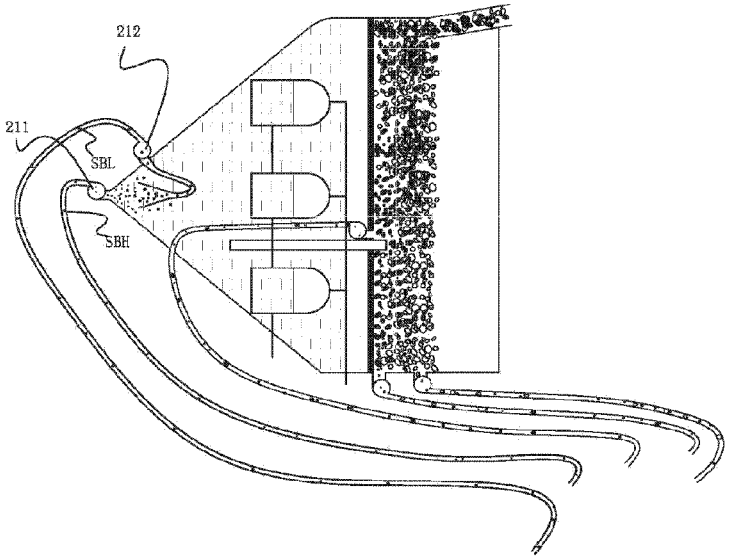
FIG. 12 is a schematic of the hutch bed slurry separation unit.

As shown in FIG. 12, on the basis of example 7, a hutch bed slurry separation unit is added.

Even though there is special arrangement on the screen openings, some small size particles still get into the hutch chamber during the jigging process. Those particles stratify by density under the centrifugal force and sink into the bottom of the hutch chamber to form bed slurry. Those particles need to be discharged as well. Lightweight bed slurry formed by low density particles might be very valuable and useful if majority of its content is micro-size coal. It can improve the slurry's particle size graduation. So this slurry should be collected for utilization. The slurry might be mainly comprised of fine clay. In this case, the slurry can be discarded or used as stabilizer for high ash coal-water slurry. Heavy bed slurry formed by high density particles is discharged as gangue. Besides the heavy slurry outlet 211, there is a conical shape lightweight slurry outlet 212 near the bottom of the hutch chamber. Those two products go into the receiver 3 fixed on the ground by the same way as mentioned earlier. The hutch water loss due to bed slurry discharge can be compensated by adding water directly in the feed slurry or by adding a hutch water supply pipe at the feed inlet.

Example 9

Figure 13:
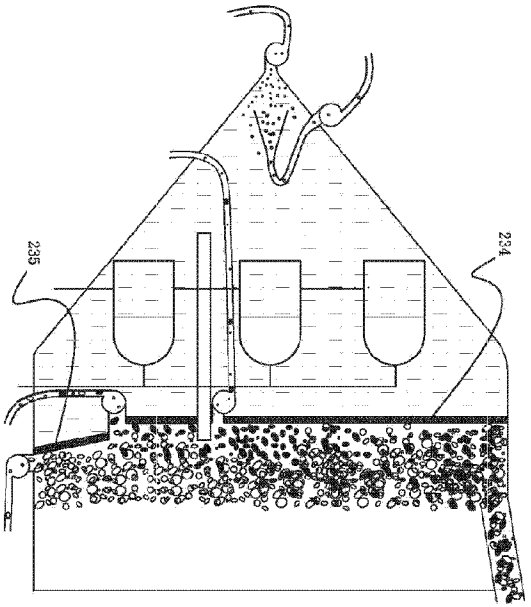
FIG. 13 is a schematic of the screen including a dilute zone and concentrate zone.

As shown in FIG. 13, on the basis of example 8, the screen is further improved by arranging a dilute zone and a concentrate zone in the screen.

In conventional jigs, the feed material is solid coal. Before it goes into the jigging area, the solid coal is washed by water. And then it flows on the screen. Clean coal is discharged with overflow water at the dean coal outlet. Coal-water feed slurry almost has the same concentration (above 65%) as the final product. It is preferable not to add water during the jigging process. Otherwise, dehydration is needed in the post process. At the beginning of jigging, the feed is diluted by hutch water. Excessive water is released under the centrifugal effect before the discharge of final product. The screen is arranged as follows. The lower region close to the feed net is the dilute zone 234 while the higher region close to the discharge outlet is the concentrate zone 235.

Obviously, technical improvements in above examples can be combined to become other technical solutions. There is no need to go into details.

The invention claimed is:

1. A centrifugal jig, comprising:

a rotating device;

at least one jig unit; and a product receiver;

the rotating device including a rotor and a base, the rotor being power-driven to rotate around a vertical shaft;

the jig unit including a hutch chamber, a screen residue chamber, a screen, a feeding device, a discharging device, and a pulsator;

the jig unit being installed on the rotor at an inclined angle along a movement of a feed;

the hutch chamber being located far away from the vertical shaft to separate particles with different densities in a slurry;

the product receiver being used to collect separated materials discharged from the jig unit wherein the separated materials are discharged from an outlet of the screen residue chamber;

and wherein said pulsator is an air-pulsed unit.

2. The centrifugal jig as recited in claim 1, wherein said inclined angle is equal to an angle between:

a vector sum of a gravitational force and a centripetal force acting on the jig unit; and a vertical direction.

3. The centrifugal jig as recited in claim 1, wherein said screen has a curved surface formed by revolving a parabola which extends along the movement of the feed around a vertical axis of the rotating device.

4. The centrifugal jig as recited in claim 1, wherein said at least one jig unit comprises two or more jig units on the rotor, and wherein said jig units are central symmetric or axial symmetric with respect to the rotating shaft.

5. The centrifugal jig as recited in claim 1, wherein said air-pulsed unit is underbed pulsed.

6. The centrifugal jig as recited in claim 1, wherein said screen residue chamber is a closed chamber in which the separated materials depart from a rotating condition at or adjacent to the rotating shaft and enter into the product receiver.

7. The centrifugal jig as recited in claim 1, wherein said jig unit has three-product structure.

8. The centrifugal jig as recited in claim 1, wherein said screen in the jig unit is a fiber screen in which upwardly stretched fiber is arranged on an upper bar of the screen having a large mesh size to cover screen openings.

9. The centrifugal jig as recited in claim 1, wherein said jig unit has a hutch bed slurry separation unit, the hutch bed slurry separation unit being disposed at a bottom of the hutch chamber and including a heavy slurry outlet and a lightweight slurry outlet of conical shape adjacent to the bottom of the hutch chamber.

10. The centrifugal jig as recited in claim 1, wherein said screen has a lower dilute zone close to a feed inlet and a higher concentrate zone close to the outlet of the screen residue chamber.

11. A centrifugal jig, comprising:

a rotating device, comprising:

a vertical shaft;

a rotor, configured to rotate around the vertical shaft; and a base;

at least one jig unit disposed on the rotor at an inclined angle, the jig unit comprising:

a hutch chamber disposed away from the vertical shaft and configured to separate particles with different densities in a slurry;

a screen residue chamber comprising an outlet, the outlet being configured to discharge separated materials from the outlet;

a screen;

a feeding device;

a discharging device; and a pulsator, wherein the pulsator is an air-pulsed unit; and a product receiver, wherein the product receiver is configured to collect the separated materials discharged from the jig unit.

12. The centrifugal jig as recited in claim 11, wherein said inclined angle is equal to an angle between:

a vector sum of a gravitational force and a centripetal force acting on the jig unit; and a vertical direction.

13. The centrifugal jig as recited in claim 11, wherein said screen comprises a curved surface defined by revolving a parabola around a vertical axis of the rotating device.

14. The centrifugal jig as recited in claim 11, wherein said at least one jig unit comprises two or more jig units, and wherein said jig units are central symmetric or axial symmetric with respect to the rotating shaft.

15. The centrifugal jig as recited in claim 11, wherein said air-pulsed unit is underbed pulsed.

16. The centrifugal jig as recited in claim 11, wherein said screen residue chamber is a closed chamber, configured such that the separated materials depart from a rotating condition at or adjacent to the rotating shaft, within the screen residue chamber, and subsequently enter into the product receiver.

17. The centrifugal jig as recited in claim 11, wherein said jig unit has a three-product structure.

18. The centrifugal jig as recited in claim 11, wherein said screen is a fiber screen comprising an upper bar and upwardly stretched fiber disposed on the upper bar, wherein the screen has a large mesh size.

19. The centrifugal jig as recited in claim 11, wherein said jig unit further comprises a hutch bed slurry separation unit, the hutch bed slurry separation unit being disposed at a bottom of the hutch chamber and comprising a heavy slurry outlet and a lightweight slurry outlet of conical shape adjacent to the bottom of the hutch chamber.

20. The centrifugal jig as recited in claim 11, wherein said screen has a lower dilute zone close to a feed inlet of the centrifugal jig and a higher concentrate zone close to the outlet of the screen residue chamber.

* * * * *